US005292132A

United States Patent [19]

Oka

[11] Patent Number: 5,292,132

[45] Date of Patent: Mar. 8, 1994

[54] GOLF BALL

[75] Inventor: Kengo Oka, Kobe, Japan

[73] Assignee: Sumitomo Rubber Industries, Inc., Kobe, Japan

[21] Appl. No.: 886,932

[22] Filed: May 22, 1992

[30] Foreign Application Priority Data

May 24, 1991 [JP] Japan ..... 3-120124

[51] Int. Cl.[5] ..... A61B 37/14

[52] U.S. Cl. ..... 273/232

[58] Field of Search ..... 273/232

[56] References Cited

U.S. PATENT DOCUMENTS

| | | | |
|---|---|---|---|
| 2,135,210 | 11/1938 | Farrar | 273/232 |
| 4,813,677 | 3/1989 | Oka et al. | 273/232 |
| 4,991,852 | 2/1991 | Pattison | 273/232 |
| 5,106,096 | 4/1992 | Dunn | 273/232 |
| 5,190,294 | 3/1993 | Oka | 273/232 |

FOREIGN PATENT DOCUMENTS

| | | | |
|---|---|---|---|
| 2322624 | 4/1977 | France | 273/232 |
| 2203954 | 11/1988 | United Kingdom | 273/232 |
| 2235879 | 3/1991 | United Kingdom | 273/232 |

*Primary Examiner*—George J. Marlo

[57] ABSTRACT

In a golf ball having dimples and lands other than the dimples formed on the surface thereof, dimples are arranged so that less than 40 lands are provided which contain a rectangle having a short side greater than 0.4 mm and an area greater than 0.8 $mm^2$ and not including a part of the dimple or the whole thereof. A land having the greatest area of all lands is so small that a dimple having an area greater than the average area of all dimples cannot be formed therein.

12 Claims, 15 Drawing Sheets

GOLF BALL

BACKGROUND OF THE INVENTION

1. Field of the Invention

The present invention relates to a golf ball and more particularly to a golf ball having an improved flight performance because of dimples densely arranged on the surface thereof.

2. Description of the Related Arts

Normally, the golf ball has 280 to 540 dimples on the surface thereof. Dimples make air flow turbulent, thereby improving the aerodynamic characteristic of the golf ball during its flight. Thus, the golf ball flies a long distance.

In view of the role of the dimple, the more densely dimples are arranged on the surface of the golf ball, the more turbulent air flow becomes and thus the golf ball has a longer flight distance. From this standpoint, various proposals of dimple arrangement have been made. For example, the present applicant made a proposal in Japanese Patent Laid-Open Publication No. 62-192181. According to the proposal, a land does not allow the formation of dimples having an area greater than the average area of dimples on the surface of the golf ball. It is to be noted that the land is a region of the surface of the golf ball other than the region of entire dimples arranged thereon.

That is, the area of the land is reduced, i.e., dimples are densely arranged on the surface of the golf ball to increase the aerodynamic characteristic thereof. The golf ball having the above-described dimple arrangement is available on the market and popular among golfers because of its superiority of its flight performance.

There is a growing demand for a golf ball having a favorable flight performance partly because feminine golfers who generally have less muscular strength than male golfers are rapidly increasing in recent years.

SUMMARY OF THE INVENTION

It is an essential object of the present invention to provide a golf ball having a long flight distance by making the area of lands smaller and arranging dimples densely on the surface thereof.

In accomplishing this and other objects of the present invention, there is provided a golf ball having less than 40 lands thereon, the area of which is approximately as small as less than 1/5 of the average area of dimples. The areas of other lands are smaller than the above-described lands.

More specifically, in a golf ball having dimples and lands, dimples are arranged on the surface thereof so that the number of lands having a comparatively large area does not exceed 40. The land satisfy the following conditions:

1. The short side of a rectangle is greater than 0.4 mm.
2. The area thereof is greater than 0.8 $mm^2$.
3. The rectangle does not contain a part of a dimple or the whole thereof.

The number of lands allowing the formation of the rectangle satisfying the above three conditions is set to less than 40 and other lands have a smaller area than the land satisfying the above conditions.

Most of the lands allowing the formation of the rectangle satisfying the above three conditions contain a rectangle having a short side of approximately 0.4 mm and an area of approximately 0.8 $mm^2$. Even a land having the greatest area is so small that a dimple having an area greater than the average area of all dimples cannot be formed therein.

A land containing a plurality of rectangles satisfying the above-described conditions or a land containing rectangles overlapping with each other is counted as well.

In shaping the golf ball, a great circle path having no dimples thereon is formed on a parting line corresponding to the connecting portion of a pair of semispherical molds. Therefore, many lands containing the rectangle satisfying the above-described conditions are formed in the vicinity of the great circle path. According to the present invention, a land in which a rectangle intersecting with the great circle path is formed is not counted.

A golf ball having no great circle path thereon can be manufactured by a method, for example, a method as described by the present applicant in Japanese Patent Laid-Open Publication No. 2-337564. Preferably, this kind of golf ball has less than 40 lands in which the rectangle satisfying the above-described conditions can be formed.

According to the present invention, the configuration of the land is defined by a rectangle although the sides of the rectangle are spherical.

According to the above dimple arrangement, the minimum area of a dimple is approximately 5 $mm^2$ because normally, the diameter of the dimple ranges from 2.50 mm to 4.50 mm. The area of each of the lands not exceeding 40 pieces is 0.8 $mm^2$ which is less than 1/5 of the dimple having the minimum area. Other lands formed on the surface of the golf ball have smaller areas and consequently, dimples are densely arranged on the surface thereof.

In the land which is comparatively large enough to form the rectangle satisfying the above-described conditions and smooth in spherical configuration, dimple effect of improving aerodynamic characteristic by making air flow turbulent is reduced. According to the present invention, the number of the lands are reduced and the areas of most of lands are small in such an extent as not to deteriorate dimple effect. Consequently, dimples are densely arranged on the surface of the golf ball. Thus, aerodynamic characteristic can be improved during the flight of the golf ball and therefore, the golf ball flies a long distance.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other object and features of the present invention will become clear from the following description taken in conjunction with the preferred embodiments thereof with reference to the accompanying drawings which are given by way of illustration only, and thus are not limitative of the present invention, and in which.

DETAILED DESCRIPTION OF THE INVENTION

Figure 1:
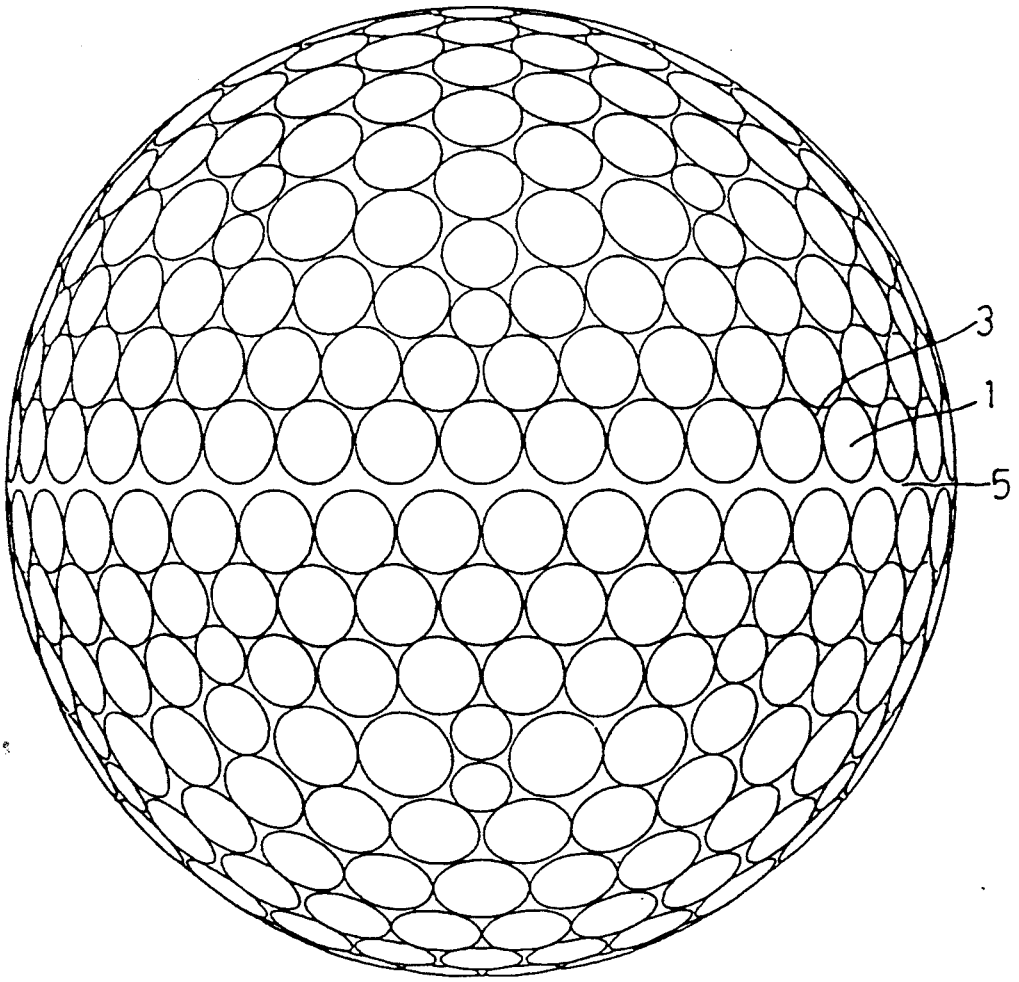
FIG. 1 is a front view showing a golf ball according to a first embodiment of the present invention.

Before the description of the present invention proceeds, it is to be noted that like parts are designated by like reference numerals throughout the accompanying drawings, Embodiments of the present invention will be described below with reference to the accompanied drawings.

Golf balls having the specification shown in Table 1 according to a first embodiment and a second embodiment of the present invention are described below with reference to FIG. 1 through 8.

TABLE 1

| | Dimple specification of embodiments and comparisons | | | | | | | | |
|---|---|---|---|---|---|---|---|---|---|
| | 1 | | | 2 (mm) | 3 (mm) | 4 ($mm^3$) | 5 ($mm^3$) | 6 | 7 (mm) |
| 1st Embodi. | 432 | A | 30 | 4.30 | 0.13 | 0.97 | 315 | 20 | 14.5 |
| | | B | 130 | 4.00 | 0.13 | 0.84 | | | 12.6 |
| | | C | 180 | 3.70 | 0.13 | 0.72 | | | 10.8 |
| | | D | 60 | 3.40 | 0.13 | 0.61 | | | 9.1 |
| | | E | 32 | 2.70 | 0.13 | 0.38 | | | 5.7 |
| 2nd Embodi. | 420 | A | 30 | 4.30 | 0.14 | 0.98 | 316 | 32 | 14.5 |
| | | B | 130 | 4.00 | 0.14 | 0.85 | | | 12.6 |
| | | C | 180 | 3.70 | 0.14 | 0.73 | | | 10.8 |
| | | D | 60 | 3.40 | 0.14 | 0.61 | | | 9.1 |
| | | E | 20 | 2.80 | 0.14 | 0.42 | | | 6.2 |
| 1st Compar. | 432 | A | 132 | 4.00 | 0.14 | 0.92 | 314 | 80 | 12.6 |
| | | B | 180 | 3.50 | 0.14 | 0.70 | | | 9.6 |
| | | C | 60 | 3.30 | 0.14 | 0.62 | | | 8.6 |
| | | D | 60 | 3.10 | 0.13 | 0.51 | | | 7.5 |
| 2nd Compar. | 420 | A | 180 | 4.00 | 0.15 | 0.96 | 315 | 182 | 12.6 |
| | | B | 60 | 3.80 | 0.14 | 0.81 | | | 11.3 |
| | | C | 60 | 3.30 | 0.14 | 0.61 | | | 8.6 |
| | | D | 120 | 3.00 | 0.13 | 0.47 | | | 7.1 |
| 3rd Compar. | 392 | A | 392 | 3.60 | 0.16 | 0.81 | 316 | 220 | 10.2 |
| 4th Compar. | 408 | A | 18 | 4.50 | 0.13 | 1.02 | 316 | 60 | 15.9 |
| | | B | 216 | 4.10 | 0.13 | 0.87 | | | 13.2 |
| | | C | 96 | 3.80 | 0.13 | 0.73 | | | 11.3 |
| | | D | 36 | 3.50 | 0.13 | 0.62 | | | 9.6 |
| | | E | 42 | 2.90 | 0.13 | 0.42 | | | 6.6 |

Figure 2:
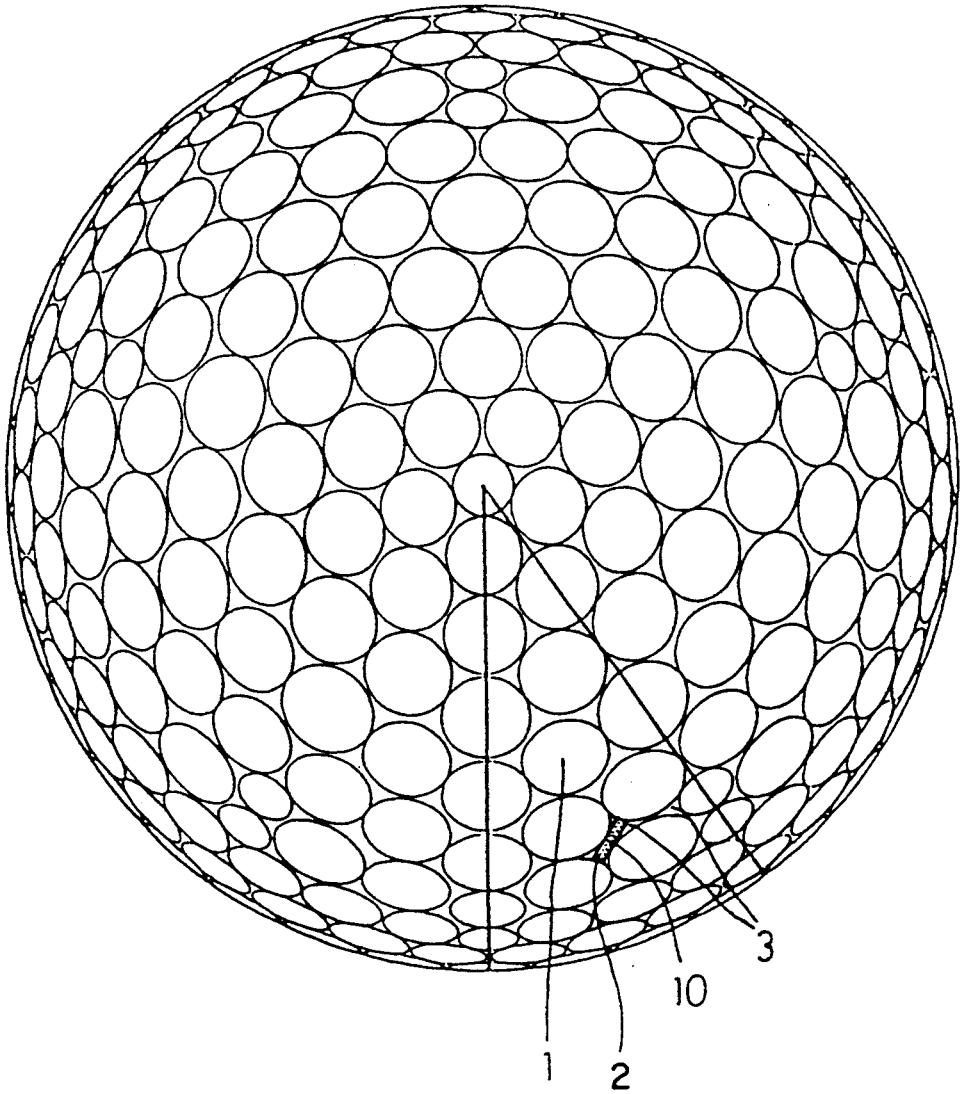
FIG. 2 is a plan view showing the golf ball according to the first embodiment of the present invention.

1; number of dimples, 2; diameter, 3; depth, 4; volume, 5; total volume, 6; number of rectangles, 7; area of dimple FIGS. 1 and 2 show a golf ball according to the first embodiment. FIG. 1 is a front view of the golf ball. FIG. 2 is a plan view thereof. The golf ball has 432 dimples consisting of five kinds of dimples A, B, C, D, and E on the surface thereof as shown in Table 1. The diameters of the dimples 1 are set to 4.30 mm to 2.70 mm. The areas of the dimples 1 are set to 5.7 $mm^2$ to 14.5 $mm^2$. Other dimple specifications are as shown in Table 1.

Referring to FIG. 2, the spherical surface of the golf ball is divided into 20 units. According to the present invention, a dotted rectangle 10 contained in one unit has a short side ss greater than 0.4 mm and an area A greater than 0.8 $mm^2$. The rectangle 10 does not include any dimples. According to the first embodiment, the rectangle 10 has a short side of 0.7 mm and an area of 1.9 $mm^2$ which is approximately 1/7 as small as the area (14.5 $mm^2$) of the dimple 1.

As shown in FIG. 2, the dimples 1 are arranged so that one rectangle 10 having a short side of more than 0.4 mm and an area greater than 0.8 $mm^2$ can be formed in one unit and there is only one land 2 which does not have an area greater than the average area of dimples 1. Since 20 units have the same dimple arrangement, the golf ball has 20 ($=1\times20$) lands 2 on the surface thereof.

Other lands 3 of one unit have an area smaller than the area of the land 2 having the above-described rectangle 10 therein and therefore, do not have an area greater than the average area of the dimples 1, either.

Figure 3:
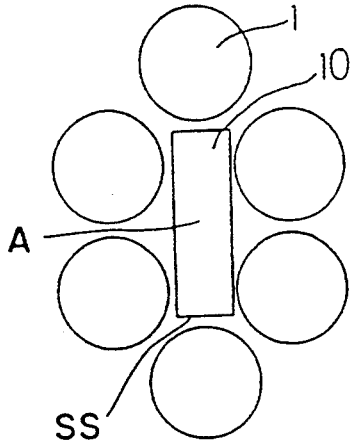
FIG. 3 is a schematic view showing the relationship between dimples and a land.
Figure 4:
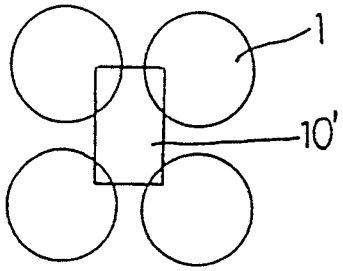
FIG. 4 is a schematic view showing the relationship between dimples and a land.
Figure 5:
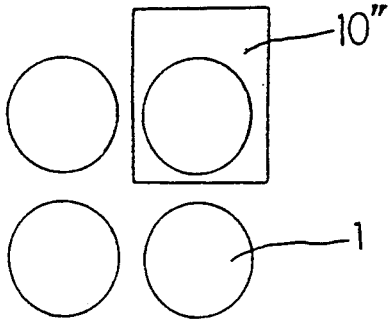
FIG. 5 is a schematic view showing the relationship between dimples and a land.

FIG. 3 shows a rectangle 10 not including a part of a dimple or the whole thereof. FIG. 4 shows a rectangle 10′ including a part of a dimple. FIG. 5 shows a rectangle 10″ including the whole of a dimple.

According to the present invention, the following lands 2 are also counted: The land 2 containing two rectangles 10 or more having a short side ss greater than 0.4 mm and an area A greater than 0.8 $mm^2$ and including neither a part of a dimple nor the whole thereof; and the land 2 in which the rectangles 10 overlap with each other as shown in FIG. 7.

Figure 6:
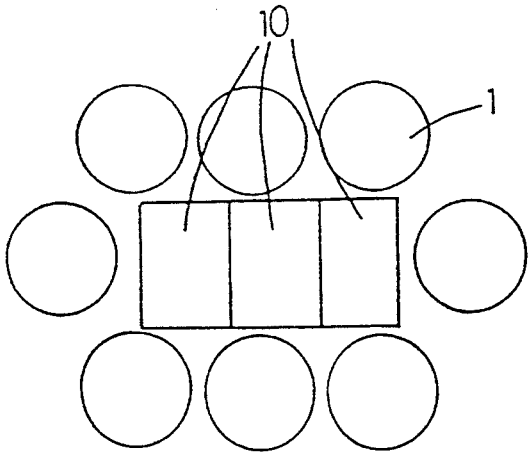
FIG. 6 is a schematic view showing the relationship between dimples and a land.
Figure 7:
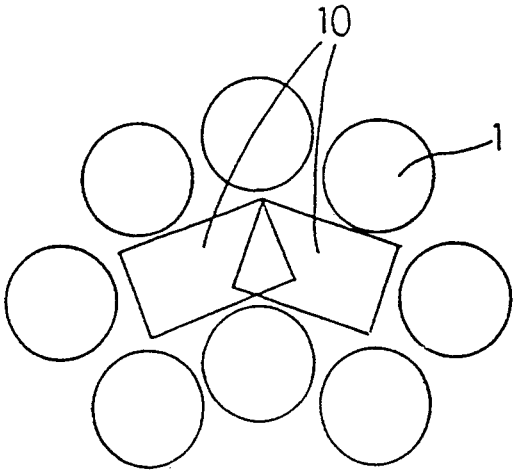
FIG. 7 is a schematic view showing the relationship between dimples and a land.

Neither the area of the land 2 shown in FIG. 6 nor the land 2 shown in FIG. 7 has an area greater than the average area of dimples.

In the golf ball according to the first embodiment, dimples cannot be formed on the parting line formed on the surface thereon in producing it by a semispherical mold. Thus, a great circle path 5 not intersecting with dimples is formed on the surface of the golf ball. Therefore, in the vicinity of the great circle path 5, there are many lands 2 containing rectangles having a short side ss more than 0.4 mm and an area A more than 0.8 $mm^2$ and not including a part of a dimple or the whole thereof, for example, as shown in FIG. 3. According to the present invention, a land in which a rectangle intersecting with the great circle path 5 is formed is not counted.

According to the present invention, in the golf ball having no great circle path 5 formed thereon, there are less than 40 lands 2, on the surface thereof, allowing the formation of a rectangle having a short side more than 0.4 mm and an area more than 0.8 $mm^2$ and not including a part of a dimple or the whole thereof.

Figure 8:
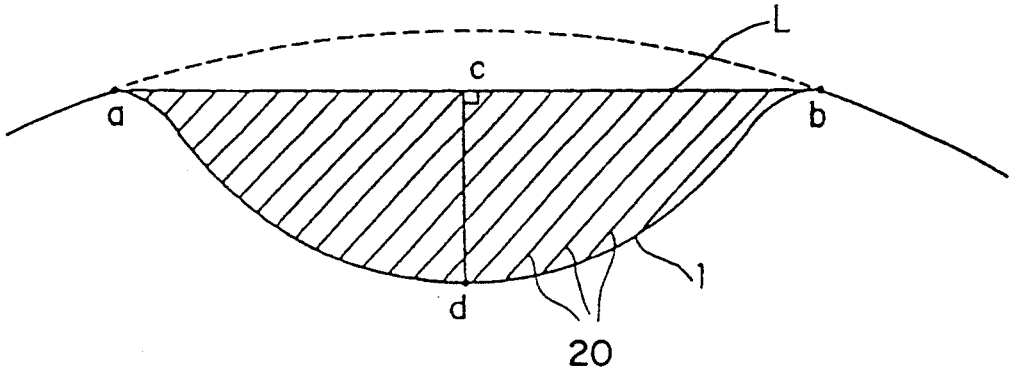
FIG. 8 is a view showing the specification of a dimple.

Referring to Table 1, diameter is the distance between contacts (a) and (b) of a common tangent (L) drawn from one end of the dimple 1 shown in FIG. 8 to the other end thereof. Depth is the distance between the midpoint of the common tangent (L) and the deepest point of the dimple 1, namely, the distance between points (c) and (d). Area is counted based on the above-described diameter. Volume is the volume of a space represented by diagonal lines 20. Total volume is the sum of the volumes of all dimples.

Figure 9:
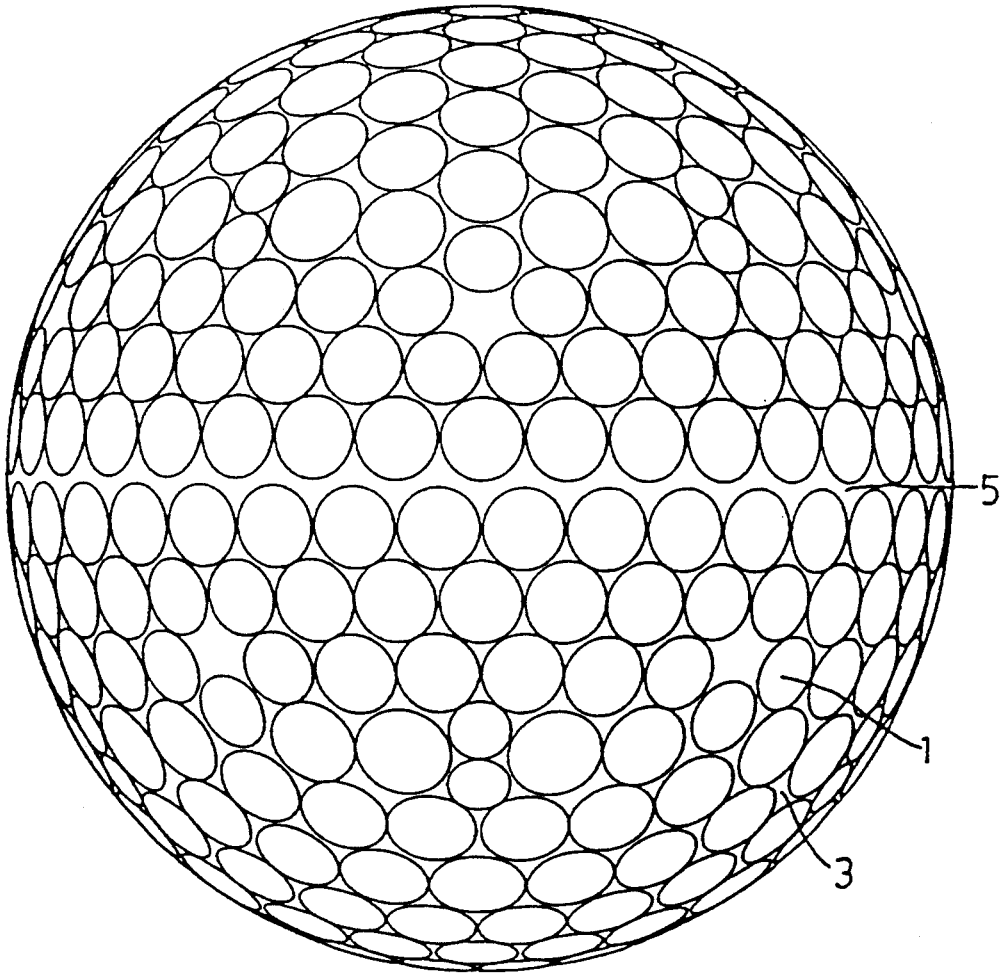
FIG. 9 is a front view showing a golf ball according to a second embodiment of the present invention.

A second embodiment of the present invention is described below with reference to FIG. 9 which is a front view showing a golf ball according to the second embodiment and FIG. 10 which is a plan view showing the golf ball according to the second embodiment. The dimple specification is as shown in Table 1. The golf ball has 432 dimples 1 formed on the surface thereof. As shown in Table 1, dimples consist of five kinds, namely, A, B, C, D, and E. The diameters of the dimples 1 are set to 4.30 mm to 2.80 mm. The areas of the dimples 1 are set to 6.2 $mm^2$ to 14.5 $mm^2$.

Figure 10:
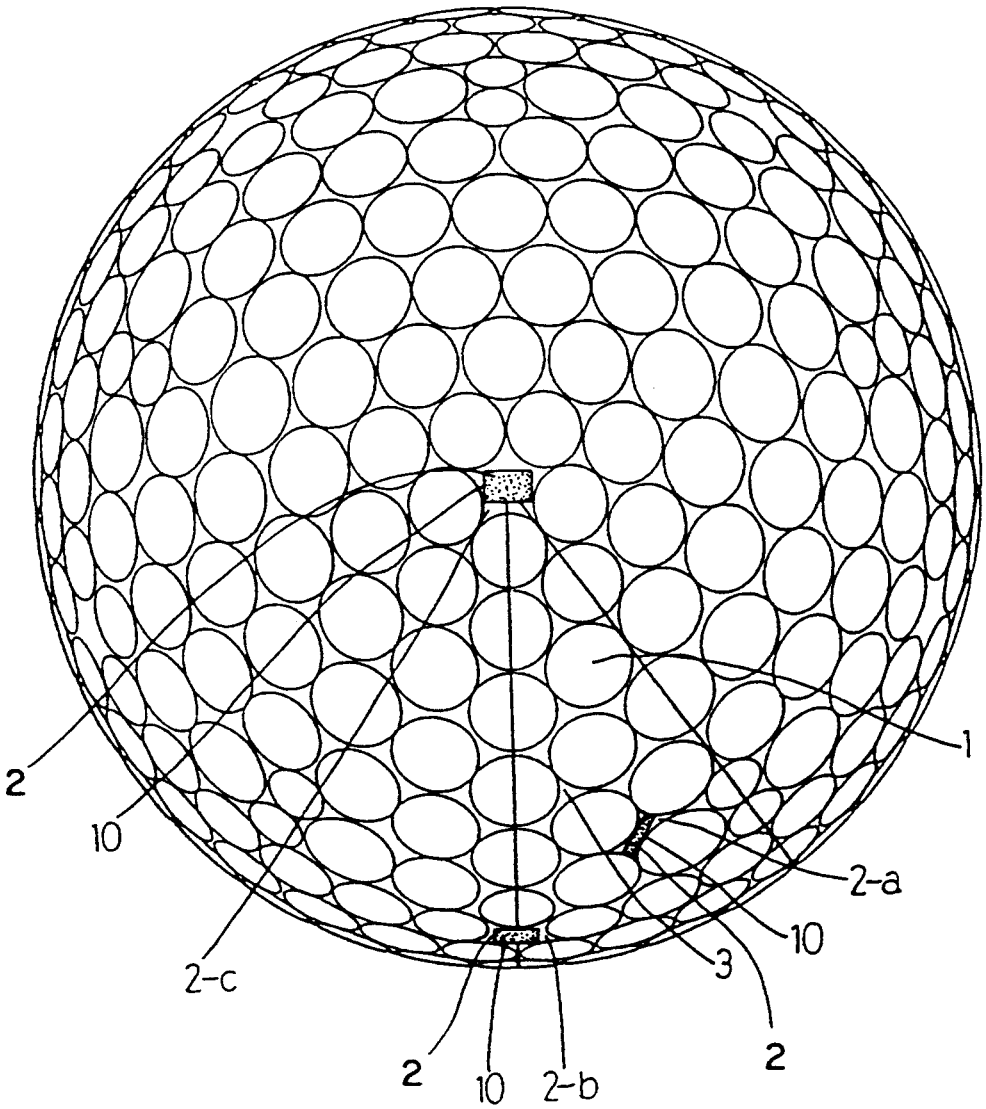
FIG. 10 is a plan view showing the golf ball according to the second embodiment of the present invention.

Similarly to FIG. 2 showing the first embodiment, FIG. 10 shows one of 20 units. Each of dotted rectangles 10 contained in one unit has a short side greater than 0.4 mm and an area greater than 0.8 $mm^2$. The rectangles 10 do not contain any dimples. As shown in FIG. 10, the number of lands 2 which allows the formation of a rectangle satisfying the above-described condition is 1.6 in one unit. The rectangle satisfying the above-described condition means a rectangle having a short side more than 0.4 mm and an area more than 0.8 $mm^2$ and not including a part of a dimple or the whole thereof.

That is, $1\times(2\text{-a})+\frac{1}{2}\times(2\text{-b})+1/10\times(2\text{-c})$, namely, $1+\frac{1}{2}+1/10=1.6$. Therefore, there are 32 ($=1.6\times20$ units) lands 2 which allows the formation of the rectangle satisfying the above-described condition on the surface of the golf ball.

The length of the short sides of the lands (2-a), (2-b), and (2-c) and the area thereof are as shown below.

TABLE 2

| | short side (mm) | area ($mm^2$) |
|---|---|---|
| land 2-a | 0.4 | 0.8 |
| land 2-b | 1.0 | 2.2 |
| land 2-c | 1.0 | 2.2 |

Comparison golf balls 1 through 4 having the dimple specification shown in Table 1 are prepared to check the dimple effect of the golf ball according to the present invention.

Figure 11:
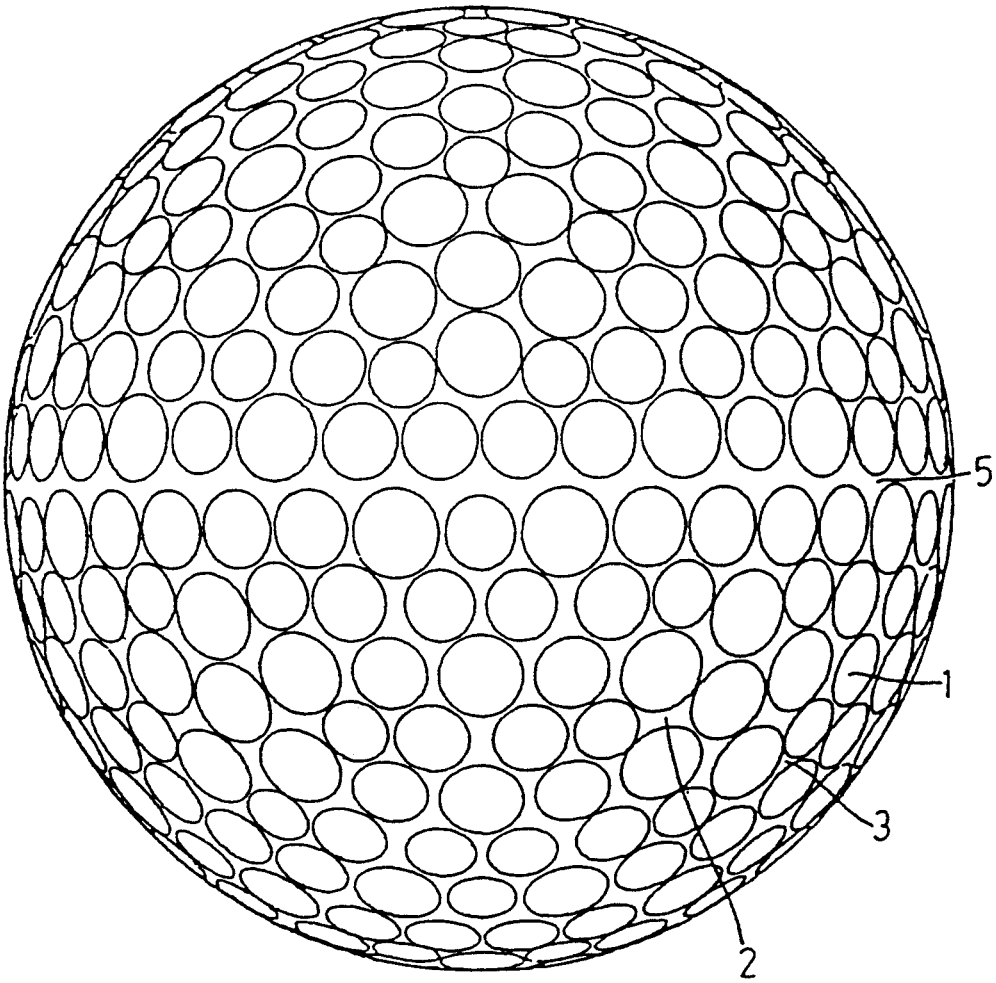
FIG. 11 is a front view showing a golf ball according to a first comparison.
Figure 12:
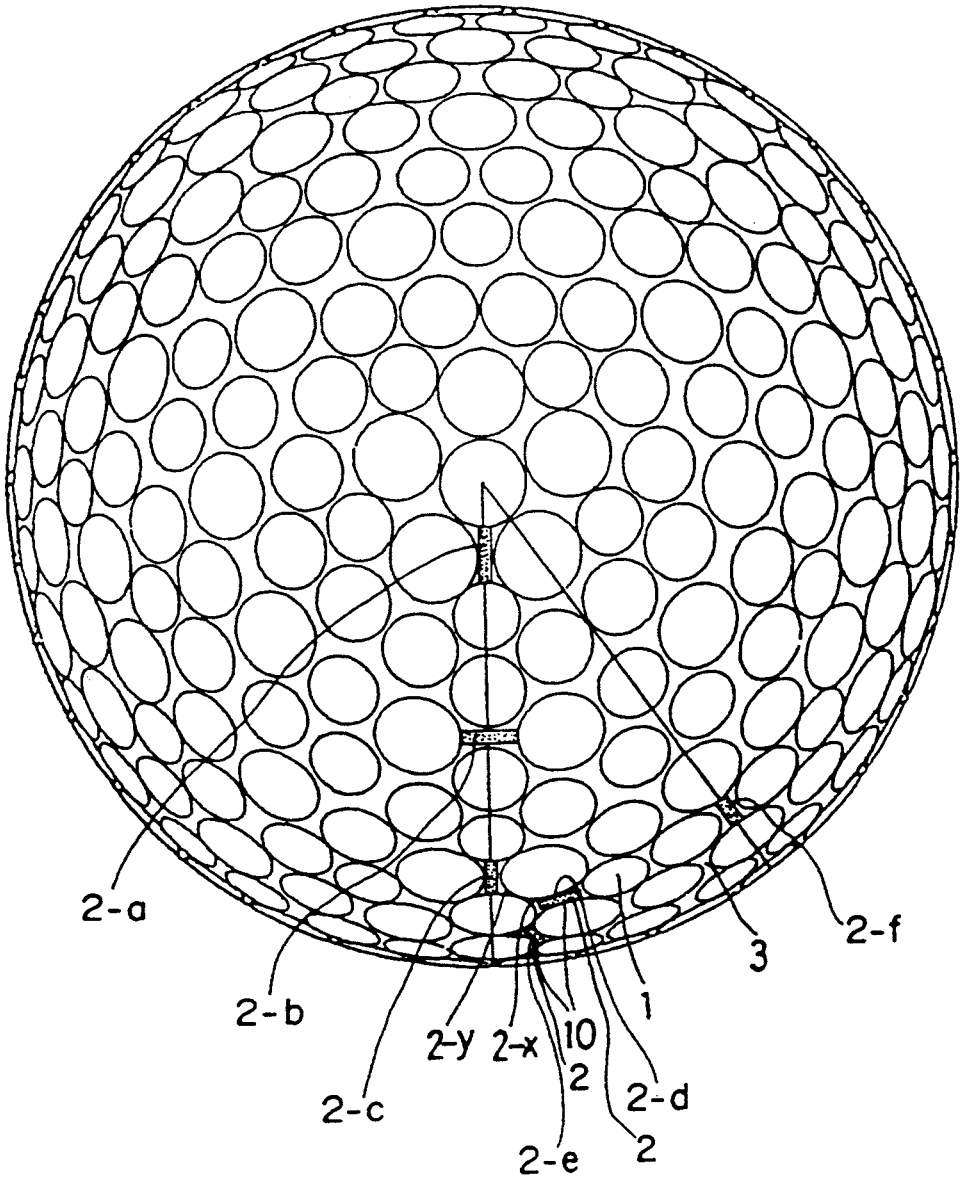
FIG. 12 is a plan view showing a golf ball according to the first comparison.

The golf ball according to the first comparison has 432 dimples on the surface thereof. FIG. 11 is a front view of the golf ball according to the first comparison and FIG. 12 is a plan view of the golf ball according to the first comparison. Similarly to FIG. 2 showing the first embodiment and FIG. 10 showing the second embodiment, FIG. 12 shows one of 20 units. Each of dotted rectangles 10 contained in one unit has a short side greater than 0.4 mm and an area greater than 0.8 $mm^2$. The rectangles 10 do not contain any dimples. As shown in FIG. 12, there are 4 ($=2+\frac{1}{2}\times4$) lands in one unit which allows the formation of the rectangle 10 satisfying the above-described condition.

That is, $2\times(2\text{-x})+4\times\frac{1}{2}\times(2\text{-y})$, namely, $2+2=4$. Therefore, the golf ball has 80 ($=4\times20$) lands 2 on the surface thereof.

According to the golf ball of the first comparison, the number of lands satisfying the above-described condition is approximately four times as many as that of the first embodiment and approximately twice as many as that of the second embodiment.

The dimple pattern of the golf ball according to the first comparison is disclosed in the fourth embodiment of Japanese Patent Laid-Open Publication No. 62-192181 described previously.

Figure 13:
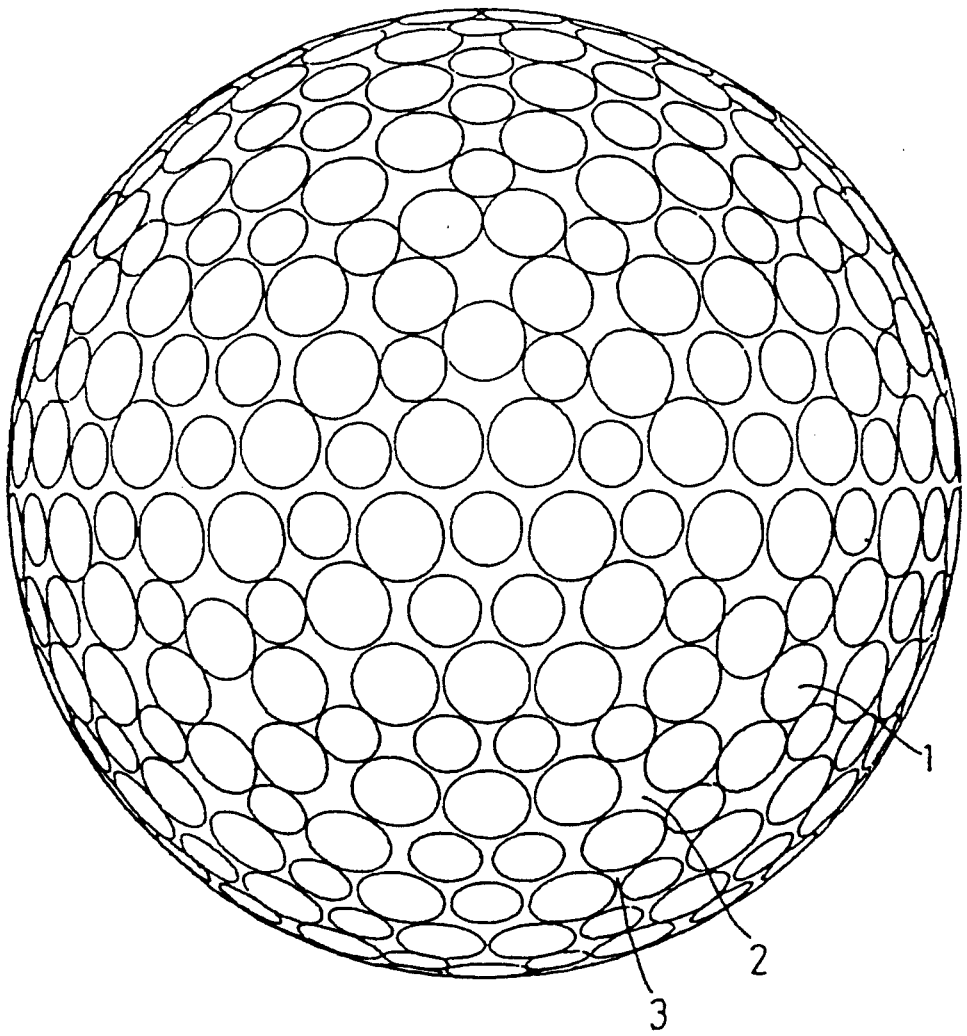
FIG. 13 is a front view showing a golf ball according to the second comparison.
Figure 14:
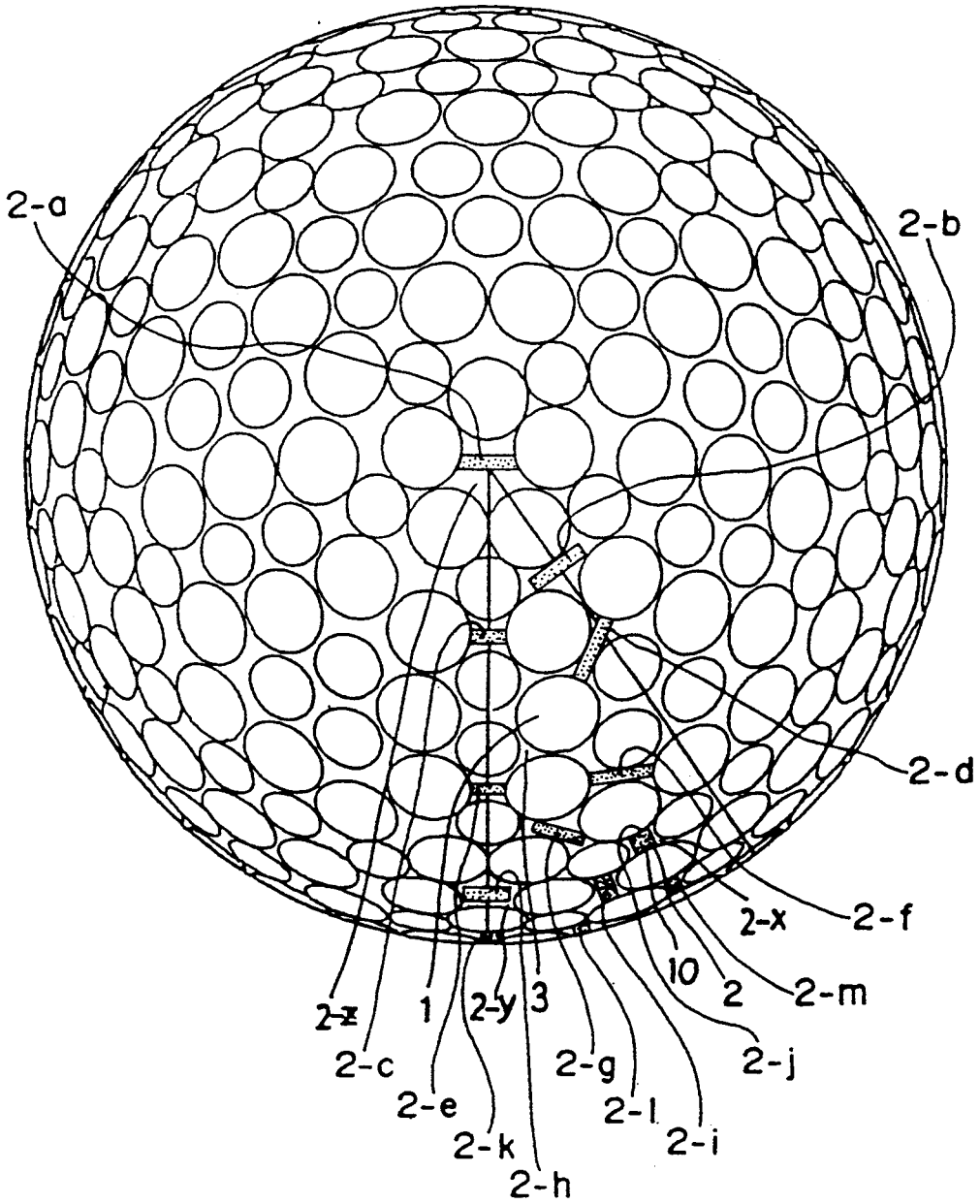
FIG. 14 is a plan view showing a golf ball according to the second comparison.

The golf ball according to the second comparison has 420 formed on the surface thereof. FIG. 13 is a front view of the golf ball according to the second comparison and FIG. 14 is a plan view of the golf ball according to the second comparison. FIG. 14 shows one of 20 units. Similarly to the first comparison, each of dotted rectangles 10 contained in one unit has a short side greater than 0.4 mm and an area greater than 0.8 $mm^2$. The rectangles 10 do not contain any dimples. As shown in FIG. 14, there are 9.1 ($=6+\frac{1}{2}\times6+1/10$) lands 2 in one unit which allows the formation of the rectangle 10 satisfying the above-described condition.

That is, $6\times(2\text{-x})+\frac{1}{2}\times6\times(2\text{-y})+1\times1/10$ (2-z), namely, $6+3+1/10=9.1$. Therefore, the golf ball has 182 ($=9.1\times20$) lands 2 on the surface of the golf ball. According to the golf ball according to the second comparison, the number of lands is approximately nine times as many as that of the first embodiment and approximately six times as many as that of the second embodiment.

The dimple pattern of the golf ball according to the second comparison is disclosed in the third embodiment of Japanese Patent Laid-Open Publication No. 62-192181 described previously.

Since the dimple pattern of the golf balls according to the first comparison and the second comparison are the same as that of Japanese Patent Laid-Open Publication No. 62-192181, the golf balls do not have a land in which a dimple having an area greater than the average area of dimples can be formed. In other words, the golf balls according to the first comparison and the second comparison have dimples densely arranged on the surface thereof, but have lands containing rectangles satisfying the above-described condition several times as many as those of the golf balls according to the first and second embodiments of the present invention. Thus, it cannot be said that the golf balls according to the first comparison and the second comparison have dimples densely arranged on the surface thereof as compared with the golf ball according to the present invention.

Figure 15:
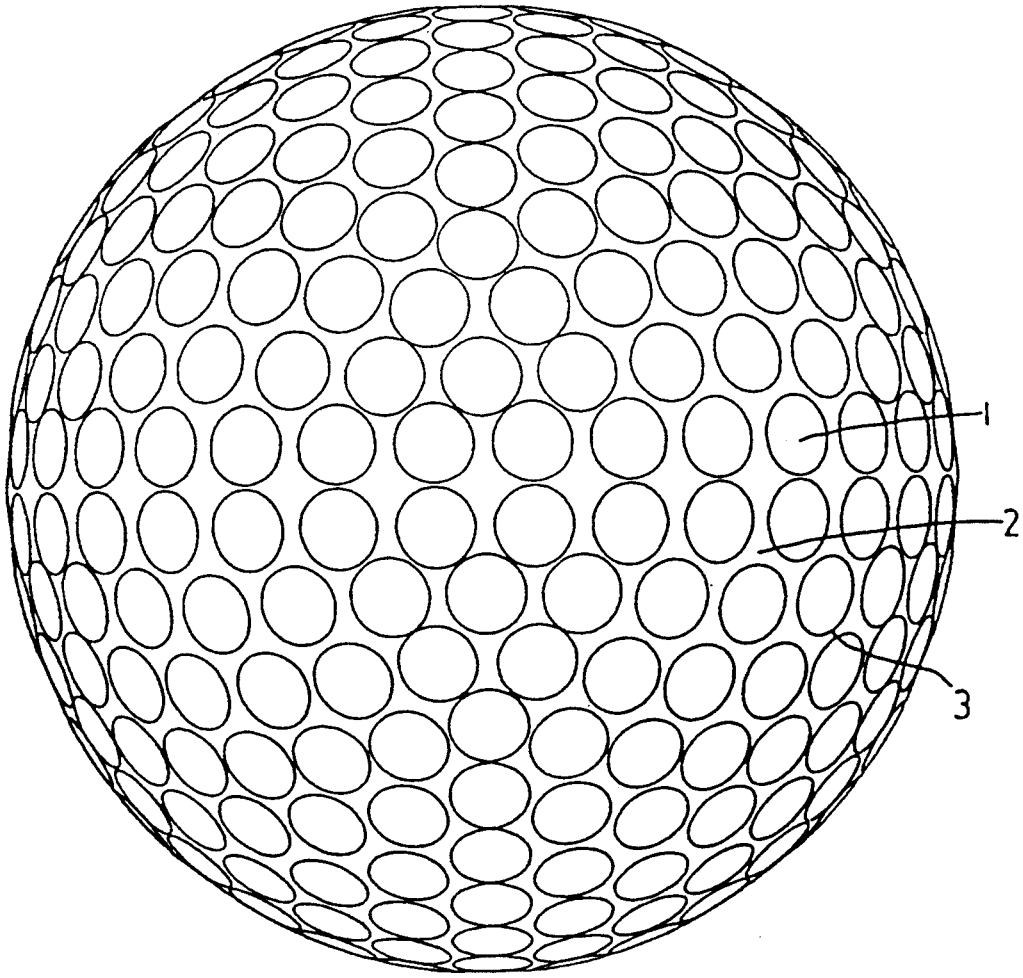
FIG. 15 is a front view showing a golf ball according to a third comparison.
Figure 16:
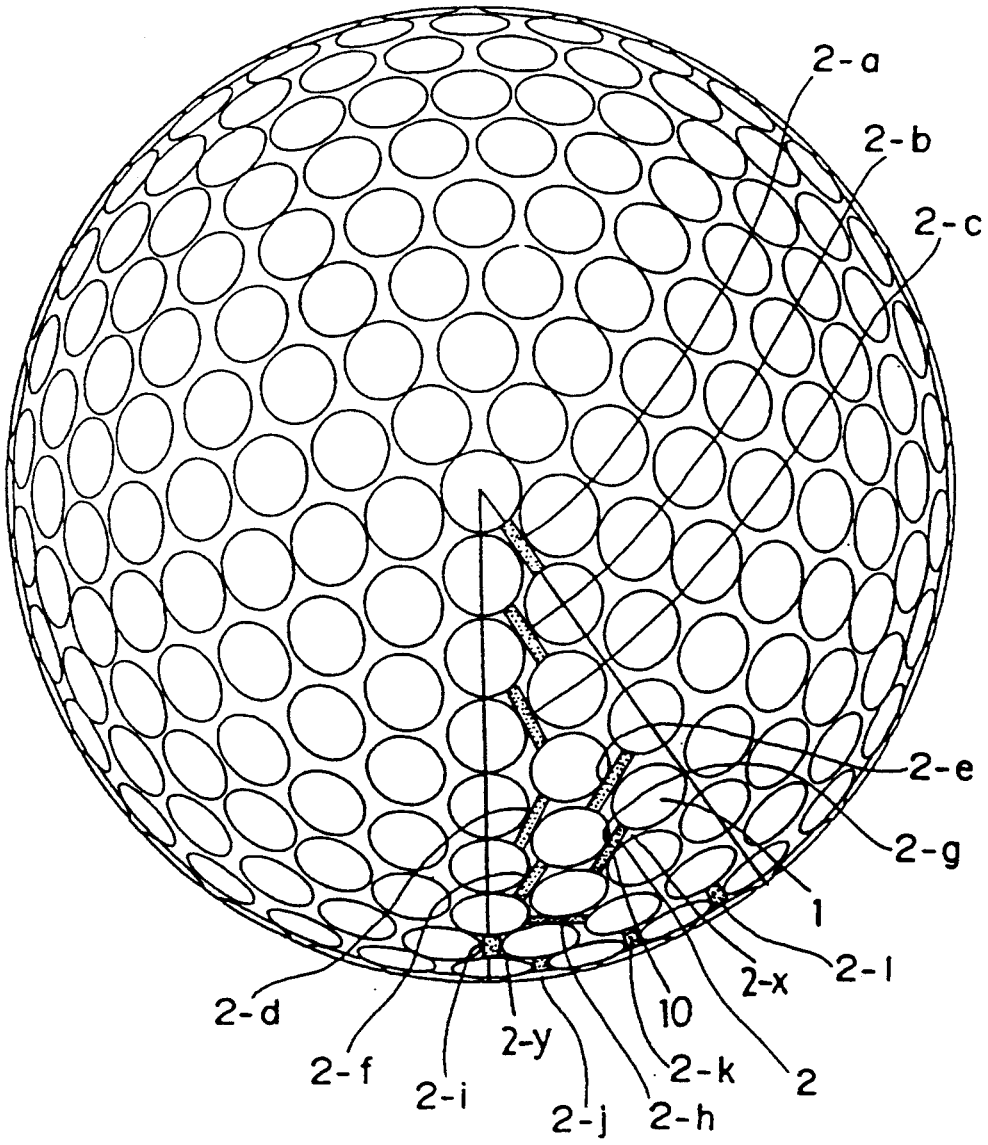
FIG. 16 is a plan view showing a golf ball according to the third comparison.

The golf ball according to the third comparison has 392 dimples on the surface thereof. FIG. 15 is a front view of the golf ball according to the third comparison and FIG. 16 is a plan view of the golf ball according to the third comparison. FIG. 16 shows one of 20 units similarly to FIG. 2. Each of dotted rectangles 10 contained in the unit has a short side greater than 0.4 mm and an area greater than 0.8 $mm^2$. The rectangles 10 do not contain any dimples. As shown in FIG. 16, the number of lands 2 having the rectangle 10 satisfying the above-described condition is 11 ($=10+\frac{1}{2}\times 2$) in one unit.

That is, $10\times(2\text{-}x)+\frac{1}{2}\times 2\times(2\text{-}y)$, namely, $10+1=11$. Therefore, the golf ball has 220 ($=11\times 20$) lands 2 on the surface thereof. According to the golf ball of the third comparison, the number of lands is approximately 11 times as many as that of the first embodiment and approximately seven times as many as that of the second embodiment. The dimple pattern of the golf ball according to the third comparison is known and still popular.

Figure 17:
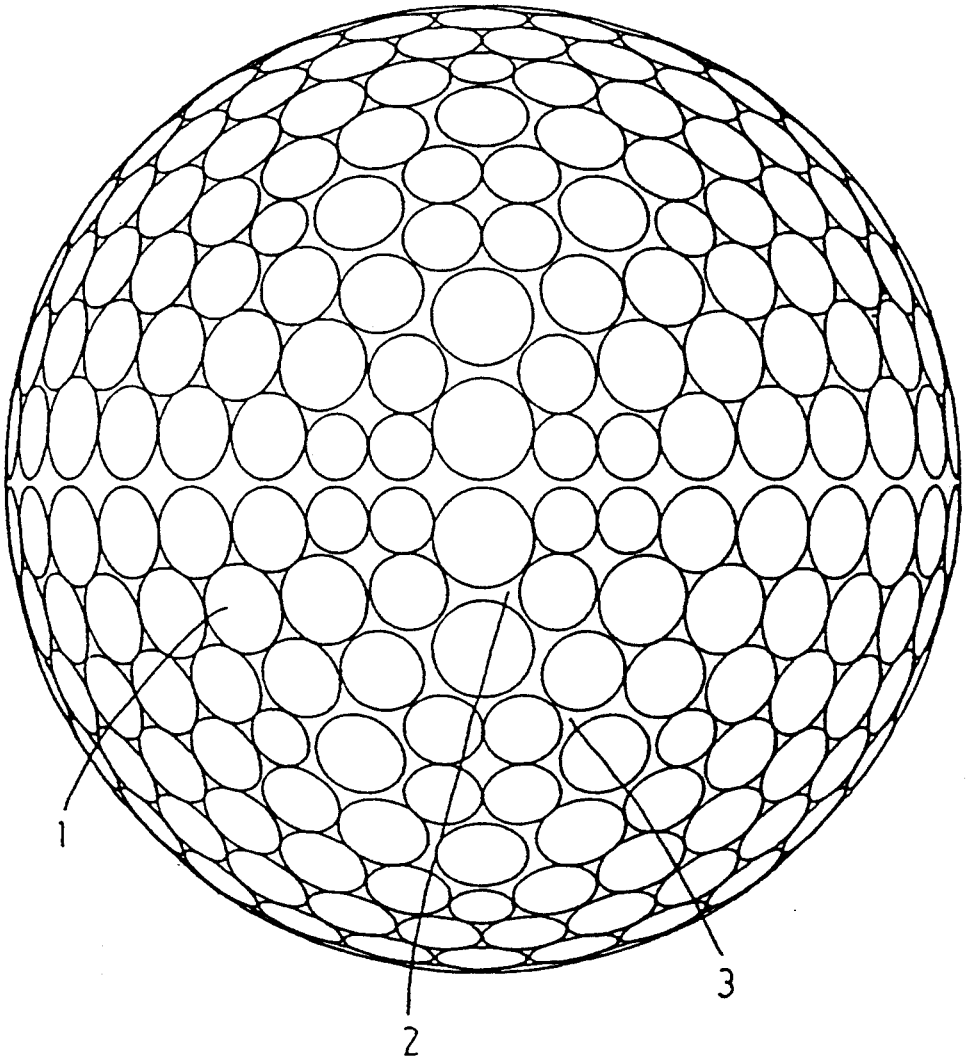
FIG. 17 is a front view showing a golf ball according to a fourth comparison.
Figure 18:
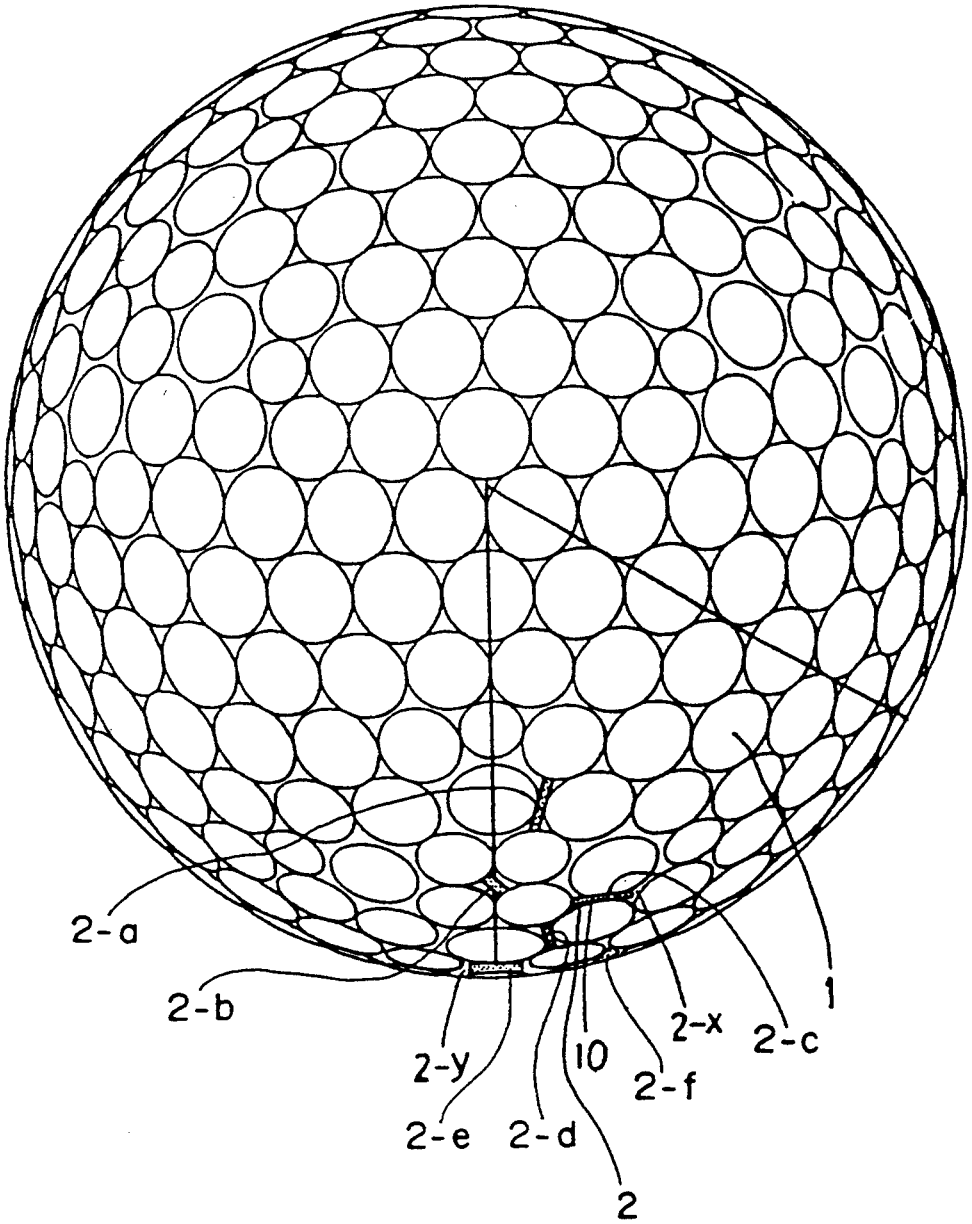
FIG. 18 is a plan view showing a golf ball according to the fourth comparison.

The golf ball according to the fourth comparison has 408 dimples on the surface thereof. FIG. 17 is a front view of the golf ball according to the fourth comparison and FIG. 18 is a plan view of the golf ball according to the fourth comparison. FIG. 18 shows one of 12 units similarly to FIG. 2. Each of dotted rectangles 10 included in one unit has a short side greater than 0.4 mm and an area greater than 0.8 $mm^2$. The rectangles 10 do not contain any dimples. As shown in FIG. 18, the golf ball has 5 ($=4+\frac{1}{2}\times 2$) lands 2 in one unit which allows the formation of the rectangle 10 satisfying the above-described condition.

That is, $4\times(2\text{-}x)+\frac{1}{2}\times 2\times(2\text{-}y)$, namely, $4+1=5$. Therefore, the golf ball has 60 ($=5\times 12$) lands 2 on the surface thereof. The golf ball of the fourth comparison has the smallest number of lands of all the golf balls according to the first through fourth comparison.

The length of the short side of the land and the area thereof of the first through fourth comparison are as shown in Table 3 below.

TABLE 3

| | short side (mm) | area ($mm^2$) |
|---|---|---|
| first comparison | | |
| land 2-a | 0.7 | 1.6 |
| land 2-b | 0.8 | 1.8 |
| land 2-c | 0.7 | 1.6 |
| land 2-d | 0.7 | 1.6 |
| land 2-e | 0.7 | 1.6 |
| land 2-f | 0.9 | 2.0 |
| second comparison | | |
| land 2-a | 1.1 | 2.9 |
| land 2-b | 0.6 | 1.5 |
| land 2-c | 1.1 | 1.5 |
| land 2-d | 0.7 | 2.0 |
| land 2-e | 1.1 | 1.5 |
| land 2-f | 0.7 | 2.0 |
| land 2-g | 0.6 | 1.5 |
| land 2-h | 1.1 | 2.9 |

TABLE 3-continued

| | short side (mm) | area ($mm^2$) |
|---|---|---|
| land 2-i | 0.6 | 1.5 |
| land 2-j | 1.1 | 1.5 |
| land 2-k | 0.6 | 1.5 |
| land 2-l | 1.1 | 1.5 |
| land 2-m | 0.7 | 2.0 |
| third comparison | | |
| land 2-a | 0.6 | 1.5 |
| land 2-b | 0.6 | 1.6 |
| land 2-c | 0.5 | 1.4 |
| land 2-d | 0.6 | 1.6 |
| land 2-e | 0.6 | 1.7 |
| land 2-f | 0.6 | 1.5 |
| land 2-g | 0.6 | 1.6 |
| land 2-h | 0.6 | 1.5 |
| land 2-i | 0.6 | 1.5 |
| land 2-j | 0.6 | 1.6 |
| land 2-k | 0.6 | 1.5 |
| land 2-l | 0.5 | 1.4 |
| land 2-m | 0.7 | 2.0 |
| fourth comparison | | |
| land 2-a | 0.4 | 0.9 |
| land 2-b | 0.9 | 0.8 |
| land 2-c | 0.4 | 0.9 |
| land 2-d | 0.5 | 1.2 |
| land 2-e | 0.4 | 1.2 |
| land 2-f | 0.4 | 0.8 |

The golf ball of the first and second embodiments and the first through fourth comparisons has a liquid center wound with thread covered with a balata cover and has the same construction and material-mixing proportion. The outer diameter thereof is all 42.70±0.03 mm and compression is all 95±2.

Flight tests of the golf balls of the first and second embodiments and the first through fourth comparisons were conducted by using a swing robot manufactured by True Temper Corp. Golf balls were hit by a driver (No. 1 wood) at a head speed of 45 m/s. Spin was 3500±300 rpm. Ball launching angle was 10±0.5. The result shown in Table 4 is the average of the result of 20 golf balls.

TABLE 4

| | flight distance (yard) | trajectory height (DEG) | duration of flight (SEC) |
|---|---|---|---|
| first embo. | 246 | 13.6 | 5.9 |
| second embo. | 245 | 13.8 | 5.9 |
| first compar. | 241 | 13.5 | 5.6 |
| second compar. | 238 | 13.6 | 5.5 |
| third compar. | 233 | 13.3 | 5.4 |
| fourth compar. | 242 | 13.8 | 5.7 |

In the above, embodiment is abbreviated as embo. and comparison is abbreviated as compar.

In Table 4, flight distance is the distance from a hitting point to a point at which each golf ball stopped. Trajectory height is an angle of elevation viewed from the launching point of each golf ball to the highest point thereof in trajectory.

As shown in Table 4, it was confirmed from the test result that the duration of flight and flight distances of the golf balls according to the first and second embodiments of the present invention were longer than those of the first through fourth comparison.

The golf ball of the fourth comparison having the fewest lands on the surface thereof was superior to those of the first comparison through the third comparison in flight distance, trajectory height, and duration of flight.

This is because of the following reason: In the land 2 which is comparatively large enough to form the rectangle 10 and smooth in spherical configuration, dimple effect of improving aerodynamic characteristic obtained by making air flow turbulent is reduced. Thus, the more the lands 2 are formed on the surface of the golf ball, the lower aerodynamic characteristic becomes during the flight of the golf ball while the fewer the lands 2 are formed on the surface of the golf ball, the more aerodynamic characteristic is improved because dimple effect does not deteriorate. Thus, the golf ball flies a long distance.

As apparent from the foregoing description, lands are arranged on the surf ace of the golf ball in a small area and the short side of a rectangle contained in a land of a comparatively large area is greater than 0.4 mm and the area of the rectangle is greater than 0.8 $mm^2$. Further, dimples are densely arranged on the surface of the golf ball so that there are less than 40 lands (less than 1/5 of the average area of dimples) in which a rectangle not including a part of a dimple or the whole thereof can be formed.

In addition to the above dimple arrangement, the area of each land of the comparatively large area is smaller than that of the land of a golf ball having the conventional dimple arrangement. Therefore, dimple effect is not deteriorated by the presence of lands and aerodynamic characteristic can be improved. Thus, the golf ball flies a long distance.

Although the present invention has been fully described in connection with the preferred embodiments thereof with reference to the accompanying drawings, it is to be noted that various changes and modifications are apparent to those skilled in the art. Such changes and modifications are apparent to those skilled in the art. Such changes and modifications are to be understood as included within the scope of the present invention as defined by the appended claims unless they depart therefrom.

What is claimed is:

1. A golf ball having dimples and lands and having a great circle around an equator thereof, the golf ball, comprising less than 40 lands containing a rectangle having a short side greater than 0.4 mm and an area greater than 0.8 $mm^2$ and not including any parts of the dimple and failing to intersect the great circle, the dimples also failing to intersect the great circle around the equator.

2. The golf ball as defined in claim 1, wherein the dimples are densely arranged on the surface of the golf ball so that less than 1/5 of an average area of dimples in which a rectangle not including a part of a dimple or the whole thereof can be formed.

3. The golf ball as defined in claim 1, wherein over 400 dimples are provided on the golf ball.

4. The golf ball as defined in claim 1, wherein 432 dimples are provided on the golf ball.

5. The golf ball as defined in claim 4, wherein a first type, a second type, a third type, a fourth type and a fifth type of dimples are provided on the golf ball, the first type of dimples having a diameter of 4.30 mm, the second type of dimples having a diameter of 4.00 mm, the third type of dimples having a diameter of 3.70 mm, the fourth type of dimples having a diameter of 3.40 mm, and the fifth type of dimples having a diameter of 2.70 mm.

6. The golf ball as defined in claim 1, wherein 420 dimples are provided on the golf bal.

7. The golf ball as defined in claim 6, wherein a first type, a second type, a third type, a fourth type, and a fifth type of dimples are provided on the golf ball, the first type of dimples having a diameter of 4.30 mm, the second type of dimples having a diameter of 4.00 mm, the third type of dimples having a diameter of 3.70 mm, the fourth type of dimples having a diameter of 3.40 mm, and the fifth type of dimples having a diameter of 2.80 mm.

8. The golf ball as described in claim 1, wherein the rectangle has a short side of 0.7 mm and an area of 1.9 $mm^2$.

9. The golf ball as defined in claim 1, wherein the golf ball is divisible into twenty, generally equally sized units with one rectangle being provided in each unit, a number of lands being equal to a number of the rectangles.

10. The golf ball as defined in claim 1, wherein three types of lands are provided, a first one of the types of lands having a short side of 0.4 mm and an area of 0.8 $mm^2$, a second one of the types of lands having a short side of 1.0 mm and an area of 2.2 $mm^2$ and a third one of the types of lands having a short side of 1.0 mm and an area of 2.2 $mm^2$.

11. The golf ball as defined in claim 10, wherein the golf ball is divisible into twenty, generally equally sized units with one of the first type of lands being provided in each unit, one-half of the second type of lands being provided in each unit and one-tenth of the third type of lands being provided in each unit such that the golf ball has 1.6 lands per unit.

12. The golf ball as defined in claim 1, wherein the golf ball is divisible into twenty, generally equally sized units with 1.6 lands being provided per unit.

* * * * *